US006725578B2

(12) United States Patent
Kerrigan

(10) Patent No.: US 6,725,578 B2
(45) Date of Patent: Apr. 27, 2004

(54) JOINT PROTECTIVE SHOE CONSTRUCTION

(75) Inventor: D. Casey Kerrigan, 90 Puritan La., Swampscott, MA (US) 01907

(73) Assignee: D. Casey Kerrigan, Swampscott, MA (US)

( * ) Notice: Subject to any disclaimer, the term of this patent is extended or adjusted under 35 U.S.C. 154(b) by 0 days.

(21) Appl. No.: 09/825,260

(22) Filed: Apr. 3, 2001

(65) Prior Publication Data

US 2002/0139011 A1 Oct. 3, 2002

(51) Int. Cl.[7] ..... A61F 5/14
(52) U.S. Cl. ..... 36/144; 36/166; 36/169
(58) Field of Search ..... 36/91, 144, 166, 36/169, 171, 172, 176, 178, 170

(56) References Cited

U.S. PATENT DOCUMENTS

| | | | | | |
|---|---|---|---|---|---|
| 717,523 | A | * | 1/1903 | Arrowsmith | 36/166 |
| 1,187,578 | A | * | 6/1916 | Watrous | 36/176 |
| 1,477,750 | A | * | 12/1923 | Endrea | 12/142 N |
| 1,477,825 | A | * | 12/1923 | Heitler | 36/162 |
| 1,832,659 | A | * | 11/1931 | Riley | 36/170 |
| 2,128,402 | A | * | 8/1938 | Chelmo | 36/172 |
| 2,188,182 | A | * | 1/1940 | Gould | 36/170 |
| 2,227,429 | A | * | 1/1941 | Austin | 36/178 |
| 2,295,212 | A | * | 9/1942 | Hamel | 324/103 R |
| 2,698,490 | A | * | 1/1955 | Goldman | 36/11.5 |
| 4,798,010 | A | | 1/1989 | Sugiyama | 36/30 R |
| 4,862,605 | A | * | 9/1989 | Gardner et al. | 36/43 |
| 5,345,701 | A | * | 9/1994 | Smith | 36/127 |
| 5,463,824 | A | | 11/1995 | Barna | 36/44 |
| 5,727,335 | A | | 3/1998 | Kousaka | 36/31 |
| 6,345,455 | B1 | * | 2/2002 | Greer et al. | 36/145 |

FOREIGN PATENT DOCUMENTS

| | | | |
|---|---|---|---|
| DE | 1147870 | 12/1959 | |
| FR | 624148 | 11/1926 | |
| JP | 11197308 | 12/1999 | A43B/7/22 |

* cited by examiner

*Primary Examiner*—Ted Kavanaugh
(74) *Attorney, Agent, or Firm*—Bromberg & Sunstein LLP

(57) ABSTRACT

A joint protective shoe construction for preventing knee and hip osteoarthritis is provided. The shoe construction includes a midsole or insole having a body with medial and lateral sides. The height of the lateral side of the body is greater than the height of the medial side, thereby forming a lateral wedge. A cantilevered arch support is also provided for transferring forces from the weight of the body to the lateral side of the shoe and foot. The arch support is adapted to support the medial side of an arch of a wearer's foot at a height above the ground. The lateral wedge and/or the arch support significantly reduce the knee and hip torques during walking, running, standing, or other weight bearing activities including athletic endeavors.

22 Claims, 4 Drawing Sheets

JOINT PROTECTIVE SHOE CONSTRUCTION

FIELD OF THE INVENTION

The present invention relates to a footwear construction for preventing knee and hip osteoarthritis, and more particularly, to a footwear construction that reduces knee and hip torques.

BACKGROUND OF THE INVENTION

Osteoarthritis, sometimes referred to as degenerative or wear-and-tear arthritis, is a common problem that affects joints, particularly the knee and hip joints. Osteoarthritis typically develops with age. The main problem in osteoarthritis is degeneration of the articular cartilage that covers the joint, which progresses slowly over time. This results in areas of the joint where bone rubs against bone. Nearly every person develops some degree of osteoarthritic changes in both the knees and hips in later adulthood.

Knee osteoarthritis in particular accounts for more disability with respect to mobility than any other disease in the elderly. Knee osteoarthritis typically occurs in two areas: on the medial aspect of the knee, and between the patella and femur. During walking (and other weight bearing activities), there is an external varus knee torque throughout the stance period, imparting a compressive force across the medial aspect of the knee. Also, during walking there is a sagittal knee flexor torque during the early to midstance phases that is proportional to the work of the quadriceps muscles which, in turn, is proportional to the strain through the patella tendon and the pressure across the patellofemoral joint.

Other than avoiding acute joint trauma and maintaining normal body weight, there are no proven measures to reduce wear and tear, thereby preventing the development of knee or hip osteoarthritis. Footwear or shoes often include material in the soles that presumably absorb shock, however, they have not been demonstrated to actually reduce joint forces or torques during walking or other weight bearing activities. Shoe designs and arch supports often support the natural arch of the foot, however, they affect only the anatomy of the foot and do not reduce (and in fact can increase) torques about the knees and hips.

Not only are there limited known measures to prevent osteoarthritis, there are limited known measures available for treating or reducing the progression of knee or hip osteoarthritis. Special shoe inserts or orthotics are sometimes used to help relieve pressure and pain. One common type of orthotic used to treat medial knee osteoarthritis has been a lateral heel or sole insert, which has been shown to reduce knee varus torque.

While this wedge-like insert to a regular shoe could be acceptable as a treatment modality for a person with knee osteoarthritis, the shoe insert alone is unlikely to be an acceptable preventative device that could be useful to a healthy person in preventing knee osteoarthritis. In use, such a shoe insert will tend to pronate the foot and collapse the natural arch. Such a tendency toward collapse of the foot arch with repetitive steps is likely to be uncomfortable for healthy people and athletes, and probably does not warrant the risk of foot injuries and deformities. Moreover, the tendency of a foot arch to collapse over time would ultimately increase rather than decrease the knee varus torque.

Thus, there is a need for footwear designs that consistently reduce the external knee varus torque and potentially also reduce the external knee flexor torque and hip torques, without interfering with the natural arch of the foot. Such footwear designs would be particularly useful for prevention of knee and hip osteoarthritis.

SUMMARY OF THE INVENTION

The present invention relates to a joint protective shoe construction for preventing as well as treating knee and hip osteoarthritis. The shoe and/or shoe components of the invention, by virtue of the biomechanical design in relation to the foot and lower extremity, reduces the forces through the knee and hip joints during ground contact with the foot. Thus, the shoe does not merely support the foot or reduce shock through the body, but alters the toques and forces proximal to the foot and ankle at the knee and hip. This shoe construction is appropriate for all types of footwear as it reduces the risk of lower extremity osteoarthritis over a lifetime.

More particularly, the invention provides a footwear construction that reduces the external varus torque about the knee. The footwear construction is further believed to reduce the external knee flexor and hip adductor and flexor torques. By reducing joint torques during weight bearing activities, the invention effectively reduces wear and tear of the knee joint and possibly the hip joint as well, thereby preventing or delaying knee and possibly hip osteoarthritis. The invention also, by reducing joint torques, would improve efficiency and performance of walking, running and other weight bearing activities including athletic endeavors. The present invention may also help relieve pain and pressure associated with knee and hip osteoarthritis, and would also slow the progression of such conditions.

In one embodiment of the present invention, a midsole is provided having a body with medial and lateral sides. The height of the lateral side of the body is greater than the height of the medial side, thereby forming a wedge-shaped profile. In one embodiment, the lateral inclination of the midsole is limited to the heel and forefoot portions. Accordingly, the medial and lateral sides of the midsole have a substantially uniform height at the toe and midfoot portions. It is believed that the wedge-shaped profile at the heel and forefoot, but not the midfoot and toe portions, will effectively reduce the peak knee varus torque and hip adductor torque values in early and late stance during walking and running.

In another embodiment, an arch support is provided for supporting the medial side of a wearer's foot. The arch support is cantilevered to transfer forces from the weight of the body to the lateral side of the shoe and foot, instead of to the medial side of the shoe and foot where it would otherwise be directed. The cantilevered arch support can be mated to the lateral side of the arch support or to the lateral side of the body of the midsole at various locations and by numerous mating techniques.

The cantilevered arch support can be used alone or in combination with the wedge-shaped midsole to reduce the knee varus and hip adductor torques during walking, standing, running, jumping and other weight bearing activities, including athletic endeavors. The cantilevered arch support is at least as effective as a standard arch support in preventing collapse of the arch and in preventing foot pain and deformities. Thus, the cantilevered arch support may be used alone to prevent excessive pronation while simultaneously reducing the knee varus and hip adductor torques. The combination of the cantilevered arch, with both a lateral angulation and flare confined to both the heel and forefoot, should be comfortable about the foot and prevent excessive pronation. At the same time, this combination reduces knee varus and hip adductor torques at both the beginning and the end of the stance. The addition of neutral height from the heel to the forefoot will also contribute to a reduction in knee varus and hip adductor torques.

In another embodiment, the body of the midsole is formed from a compressible top layer and a semi-compressible bottom layer. The bottom layer has a lateral height that is greater than the medial height, while the top layer has a medial height that is greater than the lateral height. The medial and lateral inclinations of the top and bottom layers of the midsoles can be limited to the heel and forefoot portions. The two layers together form a midsole having substantially the same height throughout the body absent any compressible force applied through a wearer's foot from the weight of the wearer's body. Due to the different compression properties of the two layers, the midsole achieves a wedge-shaped profile at the heel and forefoot portions upon the application of force from a wearer's body.

The midsole may also be formed by one or more layers or regions of materials having different compression properties. This design can result in a midsole that has a uniform thickness absent the application of body weight, but which achieves a wedge-shaped profile at the heel and forefoot upon the application of body weight. Alternatively, the one or multiple layered midsole can have a wedge-shaped profile at the heel and forefoot before the application of body weight.

In other aspects of the present invention, a shoe is provided for supporting a wearer's foot. The shoe includes an outer sole, a midsole disposed on the outer sole, and an upper mated to the midsole along a peripheral portion of the midsole. At least a portion of the lateral side of the midsole has a height that is greater than the height of the medial side of the midsole. The shoe can also include a cantilevered arch support for not only supporting the arch, but for transferring forces from the weight of the body from the medial to the lateral side of the shoe and foot.

The present invention further provides an insole insert for use in a shoe. The insole insert includes a semi-rigid body having a medial side, a lateral side, a forefoot portion, a midfoot portion, a heel portion, and optionally a toe portion. The insole insert has a lateral side height that is greater than the medial side height of the insole insert at the heel and forefoot portions. The insole insert may also include a cantilevered arch support that is attached thereto for transferring forces from the weight of the body to the lateral side of the shoe and foot. The arch support has an upwardly extending portion, which may be adapted to conform to an arch of a wearer's foot.

BRIEF DESCRIPTION OF THE DRAWINGS

The invention will be more fully understood from the following detailed description taken in conjunction with the accompanying drawings, in which like reference numerals designate like parts throughout the figures, and wherein.

DETAILED DESCRIPTION OF THE INVENTION

The present invention relates to a joint protective shoe construction for preventing as well as treating knee and hip osteoarthritis. More particularly, the invention provides a footwear construction that reduces the external torques about the knee (varus and flexor) and the hip (adductor and flexor). In general, a midsole or insole is provided having a body with a lateral wedge, which can be limited to the heel and forefoot portions. In addition, an arch support is provided for supporting the medial side of a wearer's foot. The arch support is cantilevered to transfer forces from the weight of the body to the lateral side of the shoe and foot, instead of to the medial side of the shoe and foot.

Importantly, the present invention provides footwear designs that significantly reduce knee and hip torques, thereby reducing the joint forces through the knee and hip during walking, standing, running, and other weight bearing activities, including athletic endeavors. Reducing these torques will prevent or delay the onset of knee and hip osteoarthritis, and will also improve biomechanical efficiency and overall performance during weight bearing activities. In addition, the invention provides added wearer comfort. While the preferred use of the invention is for prevention of knee and hip osteoarthritis, footwear constructed according to the present invention is also useful to those already suffering from osteoarthritis in that the construction can reduce both pain and progression of knee and hip osteoarthritis. In addition to the aforementioned benefits, footwear constructed according to the present invention also provides added wearer comfort.

Figure 1:
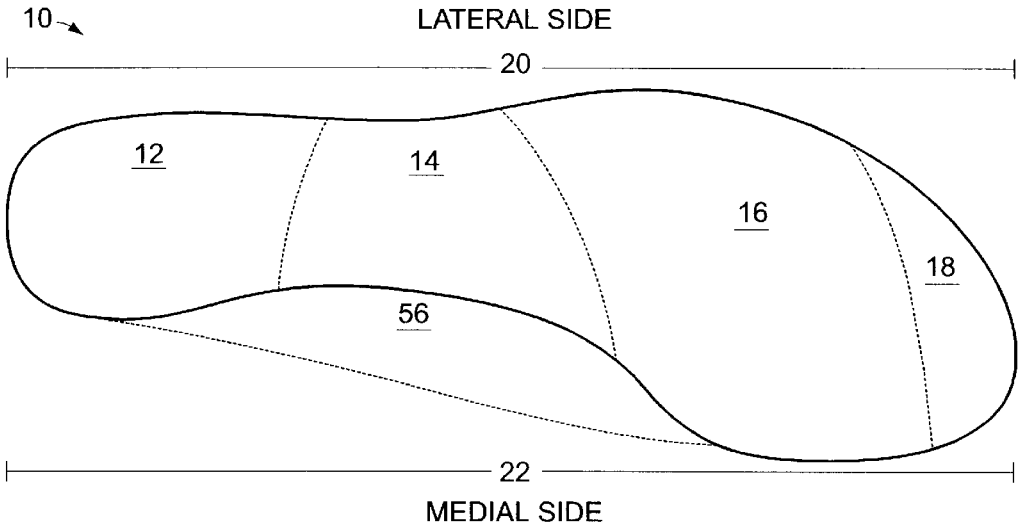
FIG. 1 PRIOR ART
FIG. 1 illustrates a top-view of the prior art portions of a foot.

FIG. 1 is shown for reference purposes only. FIG. 1 illustrates the various portions of a foot 10, including the heel portion 12, midfoot portion 14, forefoot portion 16, toe portion 18, and arch portion 56.

Figure 2:
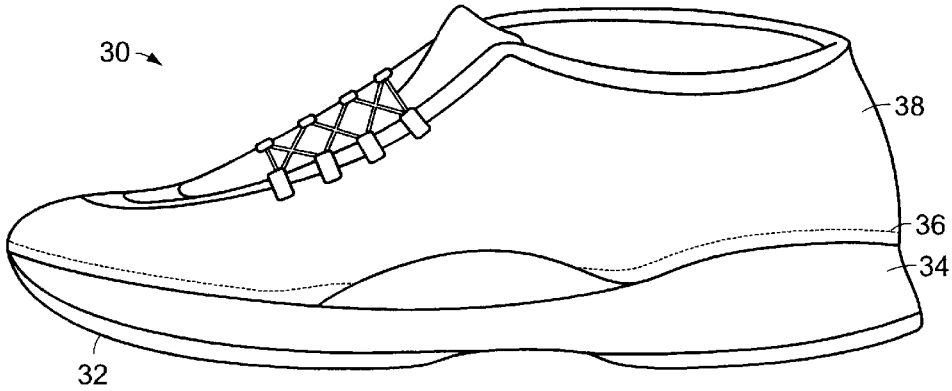
FIG. 2 illustrates a side-view of a shoe having an outer sole, midsole, sock liner, and upper according to one embodiment of the present invention.

FIG. 2 illustrates an article of footwear 30, such as an athletic shoe, sports shoe, or running shoe. Generally, the shoe 30 includes an outer sole 32 which makes direct contact with the ground surface, a midsole 34 arranged on an upper portion of the outer sole, and an upper 38 extending upwardly from the periphery of the midsole. The shoe can also include an insole insert (not shown) disposed on the midsole 34, and/or a sock liner 36 disposed on the midsole 34 or insole and surrounded by the shoe upper. The sock liner 36, or the insole insert, and the upper 38 together form a space to accommodate a human foot.

The present invention can be incorporated into virtually any type of footwear, including the shoe illustrated in FIG. 2, regardless of the structure or style of the upper or outer sole. In one embodiment, the primary features of the invention are incorporated into the midsole 34, which can be incorporated into a desired shoe design. Alternatively, the midsole 34 can be of any conventional design, and the shoe can include an insole insert, sock liner 36, or the like, incorporating the features of the present invention.

As used herein, the term "midsole" is intended to include midsoles, insole inserts, outer soles, sock liners, and the like.

Figure 3:
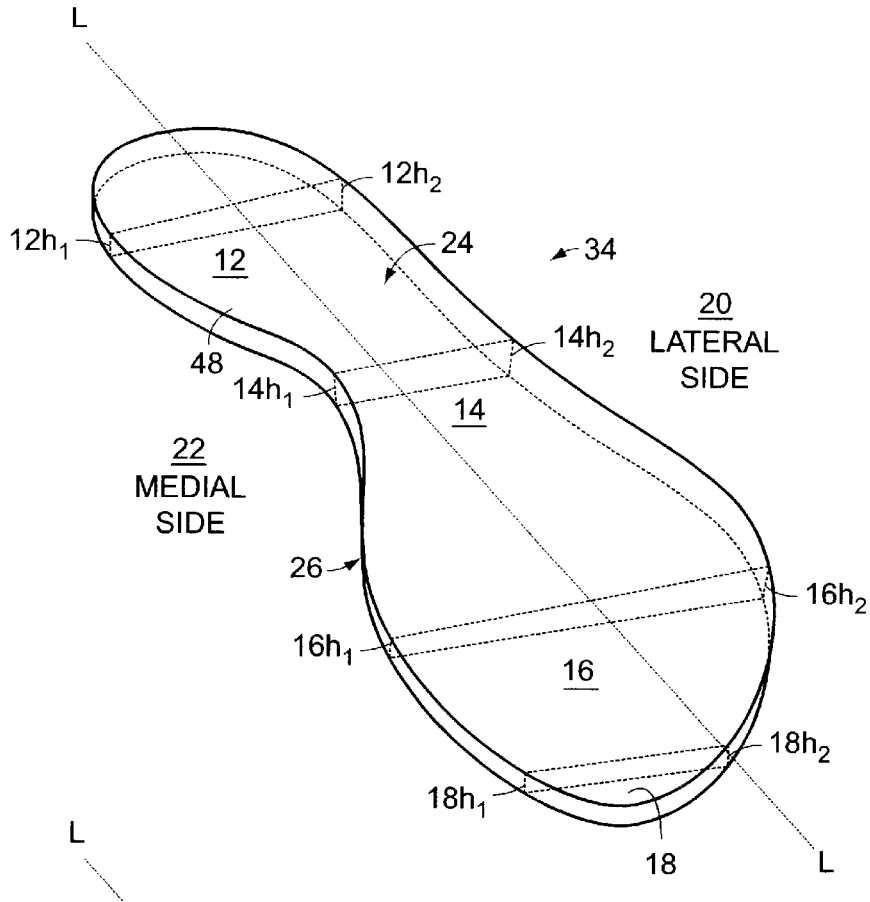
FIG. 3 illustrates a perspective view of the midsole of FIG. 2 having a lateral wedge according to one embodiment of the present invention.

FIG. 3 illustrates one embodiment of a midsole 34 according to the present invention. The midsole 34 includes a body 48 having a top surface 24, bottom surface 26, medial side 22, lateral side 20, and a toe portion 18, forefoot portion 16, midfoot portion 14, and heel portion 12. The midsole 34 can have a shape that follows the contours of a natural footprint. Alternatively, the midsole 34 can extend medially beneath the arch of a wearer's foot without any laterally extending indentation at the arch portion 56 (FIG. 2).

The body 48 of the midsole 34 has a wedge-shaped profile (sometimes referred to as the "lateral wedge") in which the lateral side 20 of the body 48 has a height h that is greater than the height of the medial side 22 of the body 48. The difference in height between the medial 22 and lateral 20 sides of the midsole defines an incline or lateral wedge, which can extend along the length of the midsole 34, or can vary along different portions of the midsole.

As shown in FIG. 3, the height of the medial and lateral sides 22, 20 of the body 48 varies throughout the length of the body 48. The toe 18 and midfoot 14 portions each have respective medial heights 18$h_1$, 14$h_1$, and respective lateral heights 18$h_2$, 14$h_2$ that are substantially the same. Conversely, the heel 12 and forefoot 16 portions each have respective lateral heights 12$h_2$, 16$h_2$ that are greater than their respective medial heights 12$h_1$, 16$h_1$. The height differential from the medial side 22 to the lateral side 20 at the heel 12 and forefoot 16 portions defines a slope having an incline in the range of about 2° and 12°, more preferably in the range of about 4° and 5°, and most preferably about 5°.

While the height may vary between the medial 22 and lateral 20 sides of the body 48, the midsole 34 can support the heel 12 and forefoot 16 portions at substantially the same height along the longitudinal axis L. This feature is believed to contribute to a reduction in the knee flexor and hip flexor torque, and will also help reduce the knee varus and hip adductor torques compared to traditional footwear.

Figure 4:
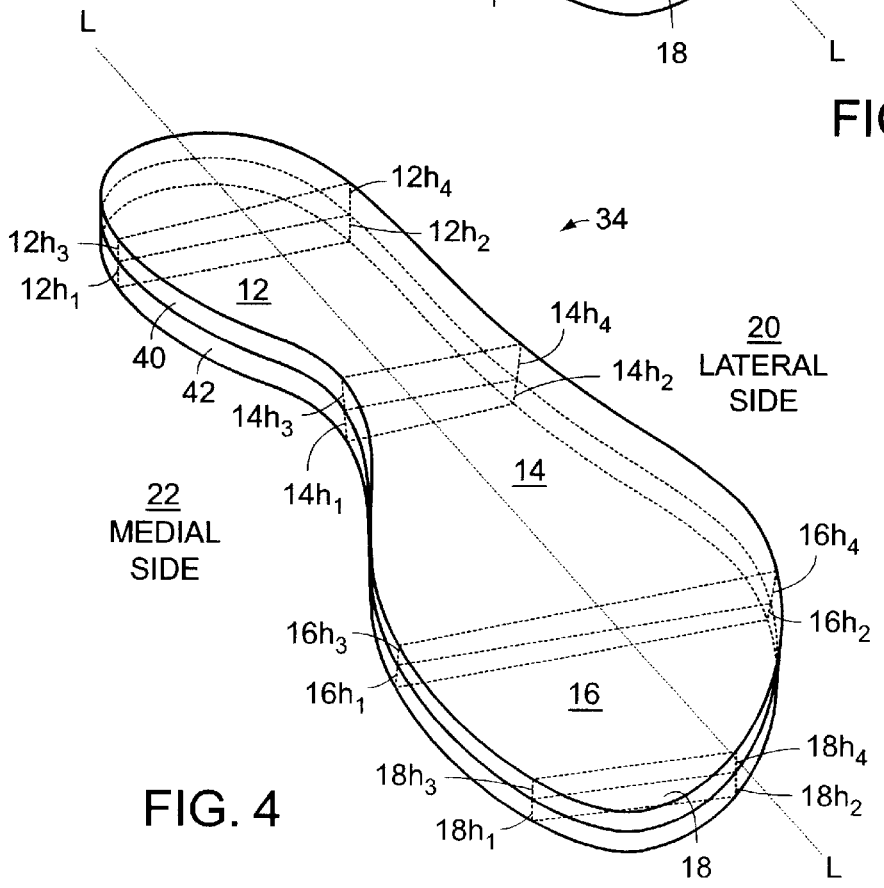
FIG. 4 illustrates a perspective view of the midsole of FIG. 2 having a top layer with a medial incline and a bottom layer with a lateral incline according to another embodiment of the present invention.

FIG. 4 illustrates another embodiment of the midsole 34 according to the present invention. As shown in FIG. 4, the midsole 34 includes a top layer 40 and a bottom layer 42. The bottom layer 42 has a wedge-shaped profile in which the lateral side 20 has a height greater than the medial side 22, as described with respect to FIG. 3. The top layer 40, on the other hand, includes a medial wedge-shaped profile in which the medial side has a height greater than the lateral side. The toe 18 and midfoot 14 portions of the top layer 40 each have respective medial heights 18$h_3$, 14$h_3$ and respective lateral heights 18$h_4$, 14$h_4$ that are substantially the same. Conversely, the heel 12 and forefoot 16 portions each have respective lateral heights 12$h_4$, 16$h_4$ that are greater than their respective medial heights 12$h_3$, 16$h_3$. The top layer 40, like the bottom layer 42, can support the heel 12 and forefoot 16 portions at substantially the same height along the longitudinal axis L.

The top layer 40 preferably is made from a compressible material, while the bottom layer 42 is semi-compressible or substantially non-compressible. Preferably, the top layer 40 is more compressible than the bottom layer 42. As a result of the increased compressibility of the top layer 40, the medial wedge of the top layer 40 does not interfere with the desired effect of the lateral wedge of the bottom layer 42. That is, the desired wedge-shaped profile of the midsole, at the heel and forefoot portions, is achieved upon the application of body weight.

While FIG. 4 illustrates a compressible top layer 40 having a medial wedge, and a semi-compressible (or non-compressible) bottom layer 42 having a lateral wedge, a person having ordinary skill in the art will readily appreciate that variations can exist without departing from the scope of the invention. For example, the midsole can be formed from a single layer of material having the same height throughout the material, but having a compressible medial side, and a semi-compressible or substantially non-compressible lateral side such that, during use and on weight bearing, a wedge-shaped profile is achieved. Alternatively, the midsole can be formed from several different materials present in different regions of the midsole, in which the compressibility differs between materials, and/or within each material. For example, the medial side of the midsole can include a single layer of compressible and/or semi-compressible material, and the lateral side can include several layers of a substantially non-compressible material. Moreover, additional layers can be provided at the heel and forefoot portions of the lateral side. The different materials used can be selected based on the desired use of the shoe or midsole.

One having ordinary skill in the art will also appreciate that the midsole may assume a variety of shapes. For example, the midsole may have concave or convex edges. There also may be variations in the surfaces of the midsoles as long as an average lateral wedge shape is maintained with an inclination of about 2° to 12° degrees laterally, more preferably about 4° to 5°, and most preferably about 5°. For example, there may be slight indentations to accommodate the heel, forefoot, or toes, with an overall average inclination of the sole from about 2° to 12° degrees laterally, more preferably about 4° to 5°, and most preferably about 5°.

The lateral wedge design described above with respect to FIGS. 3 and 4 can be used in a shoe design alone or in combination with a cantilevered arch support as described below.

The midsole 34 can be made from a single layer, or several layers, of a variety of materials that are well known in the footwear industry. In addition, the type of material and material properties can vary throughout the midsole. Preferably, the midsole 34 should have sufficient resiliency to return to its original shape after compression. By way of non-limiting example, suitable materials for the midsole include polymers, naturally occurring materials such as rubber and leather, gas and fluid filled bladders, and composites. Exemplary polymers include elastomeric foams, such as ethylene vinyl acetate (EVA) and polyurethane (PU).

Figure 5:
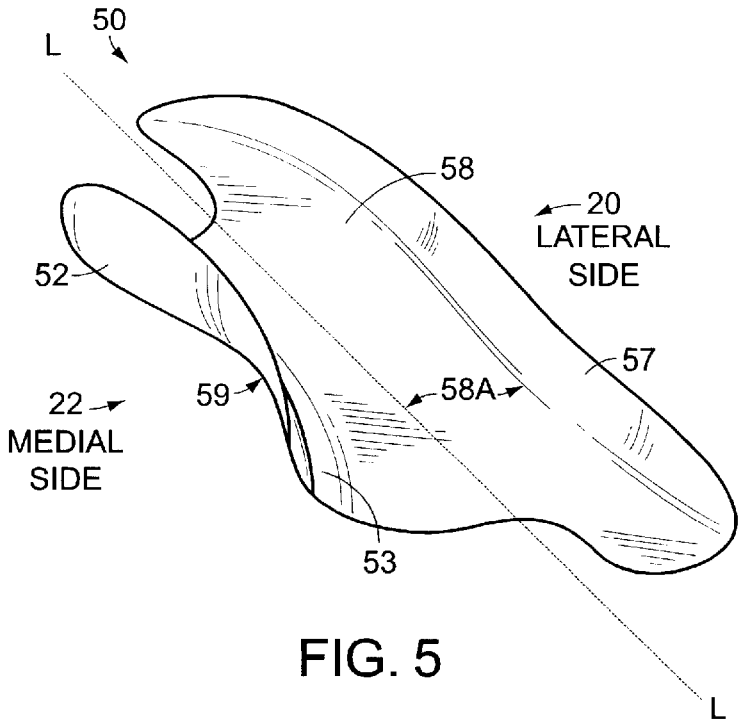
FIG. 5 illustrates a perspective view of an arch support having an upwardly extending portion according to one embodiment of the present invention.

FIG. 5 illustrates an arch support 50 according to one embodiment of the present invention. The arch support 50 includes a lateral side 20, a medial side 22, a foot contacting surface 58, and an upwardly extending member 52. As illustrated in FIG. 5, the arch support 50 may have a size such that it extends along the longitudinal axis L over all or a portion of the midfoot, heel, and forefoot. Preferably, the lateral side 20 of the arch support member extends along the entire length of the midsole, or, as shown in FIG. 5, it extends from the middle of the forefoot 16 to the middle of the heel 12. The medial side 22 of the arch support, on the other hand, preferably extends only along the midfoot portion 14.

The foot contacting surface 58 of the arch support 50 includes a lateral portion 58*a*, which terminates at or near the longitudinal axis L, and an arch contacting surface 53 that extends medially from the longitudinal axis L.

Preferably, the arch support 50 is cantilevered or floating such that the arch-contacting surface and its opposed non-foot contacting surface 59 are suspended above the midsole 34 in the arch portion 56 of a foot. The cantilevered construction of the arch support 50 is effective to transfer forces from the weight of the body that would otherwise be directed to the medial side of the shoe and foot, to the lateral side of the shoe and foot.

The arch contacting surface 53 of the upwardly extending member 52 can be shaped to contour the arch of a wearer's foot, or alternatively it can have a variety of other shapes. For example, the upwardly extending member 52 can be planar or convex and can extend at an upward incline from the medial 22 or lateral 20 side of the foot supporting surface 58. The arch contacting surface 53 of the upwardly extending member 52 supports the wearer's arch at a height above the ground such that the entire medial side 22 from the longitudinal axis L of the arch support 50 is cantilevered. As a result, the forces from the weight of the wearer's body are transferred to the lateral side of the shoe and foot, thereby reducing the knee varus torque and hip adductor torque.

The arch support 50 can also include a lateral wall 57 extending upwardly from the lateral side 20 of the foot supporting surface 58 for securing the arch support to a shoe and in particular, to the upper 38 of a shoe. Alternatively, or in addition, the lateral wall can extend downwardly to contact the outer periphery of the midsole and/or outer sole of a shoe, or it can extend around the periphery of the midsole and between the outer sole and the midsole.

The cantilevered arch support can be incorporated into a shoe design by itself, or in combination with a midsole having the lateral wedge designed as described above.

The arch support 50 can be made from any rigid or semi-rigid material that is effective to support the medial part of the foot. The arch support 50 can also be semi-elastic, elastic, semi-flexible, and/or flexible. Suitable materials from which the arch support can be made include polymers, composite materials, and naturally occurring materials such as rubber and leather. The arch support can also include rigid reinforcing inserts that are embedded therein, such as, for example, metal, plastic, or composites, to provide added rigidity and can be striated or porous to reduce weight and improve breathability.

Figure 6:
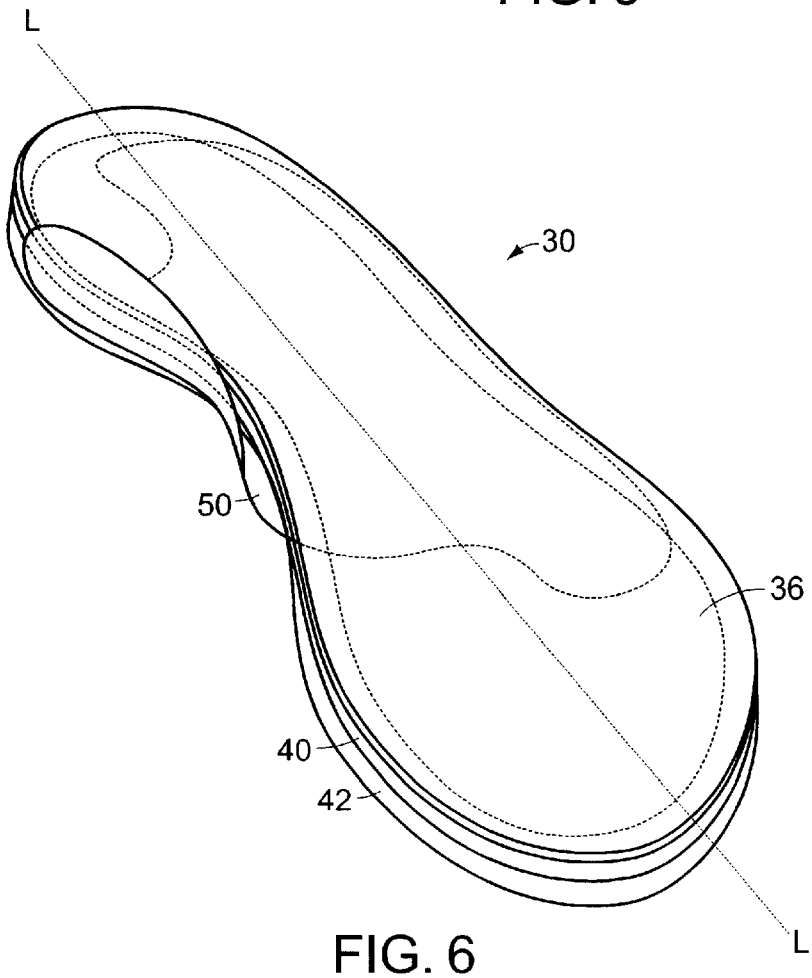
FIG. 6 illustrates a perspective view of the arch support of FIG. 5 disposed between the sock liner of FIG. 2 and the midsole of FIG. 4 according to yet another embodiment of the present invention.

FIG. 6 illustrates a partially assembled shoe construction according to the present invention in which arch support 50 is joined between midsole 34 and sock liner 36. These components can be incorporated into a fully constructed shoe, such as the shoe 30 shown in FIG. 2 having an outer sole and an upper. The midsole 34 has top and bottom layers 40, 42 of the type shown in FIG. 4 and described above. Further, the arch support 50 is disposed between the top layer 40 of the midsole 34 and the sock liner 36. The arch support 50 can be attached to the midsole 34 along the lateral side of body 48, or it can be embedded in or integral with the midsole 34. The sock liner 36 is shaped to conform to a wearer's foot, and can be made from any suitable material, as known to those having ordinary skill in the art. The sock liner 36 can include an upwardly extending portion (not shown) at the midfoot portion along the medial side of the sock liner 50 to provide additional comfort to the wearer. The sock liner can also include a lateral wedge, similar to the lateral wedge of the bottom layer 42 of the midsole 34, or a medial wedge similar to the top layer 40 of the midsole 34.

As noted above, the arch support 50 is preferably attached to the lateral side of body 48 of midsole 34 and/or the upper 38 (not shown) at the foot supporting surface 58 and/or the upwardly extending lateral wall 57. Attachment of the lateral portion, or upwardly extending lateral wall, of the arch support 50 to the lateral side of the body 48 is advantageous in that it helps distribute loads to the lateral side of the foot, thereby reducing knee varus torque, thereby reducing loading of the medial compartment of the knee of a wearer. Alternatively, and/or in addition to, the arch support 50 can be integral with the midsole 34.

Attachment of the arch support 50 to the body 48 can be accomplished by a variety of techniques that will be readily appreciated by one having ordinary skill in the art. For example, attachment can be effected by adhesives, ultrasonic welding, sewing, and similar techniques. In one embodiment, the medial side 22 of the arch support 50 is embedded in the fabric of the upper 38. Attachment of the medial portion of the arch support to the upper 38 (not shown) is advantageous since when the upper is tightened with laces, velcro, buckles or the like, the medial part of the foot is further supported beyond the cantilevered support so that it does not make contact with the ground. This will help shift the body weight forces laterally to the foot, thereby reducing the varus knee and hip adductor torques.

Figure 7:
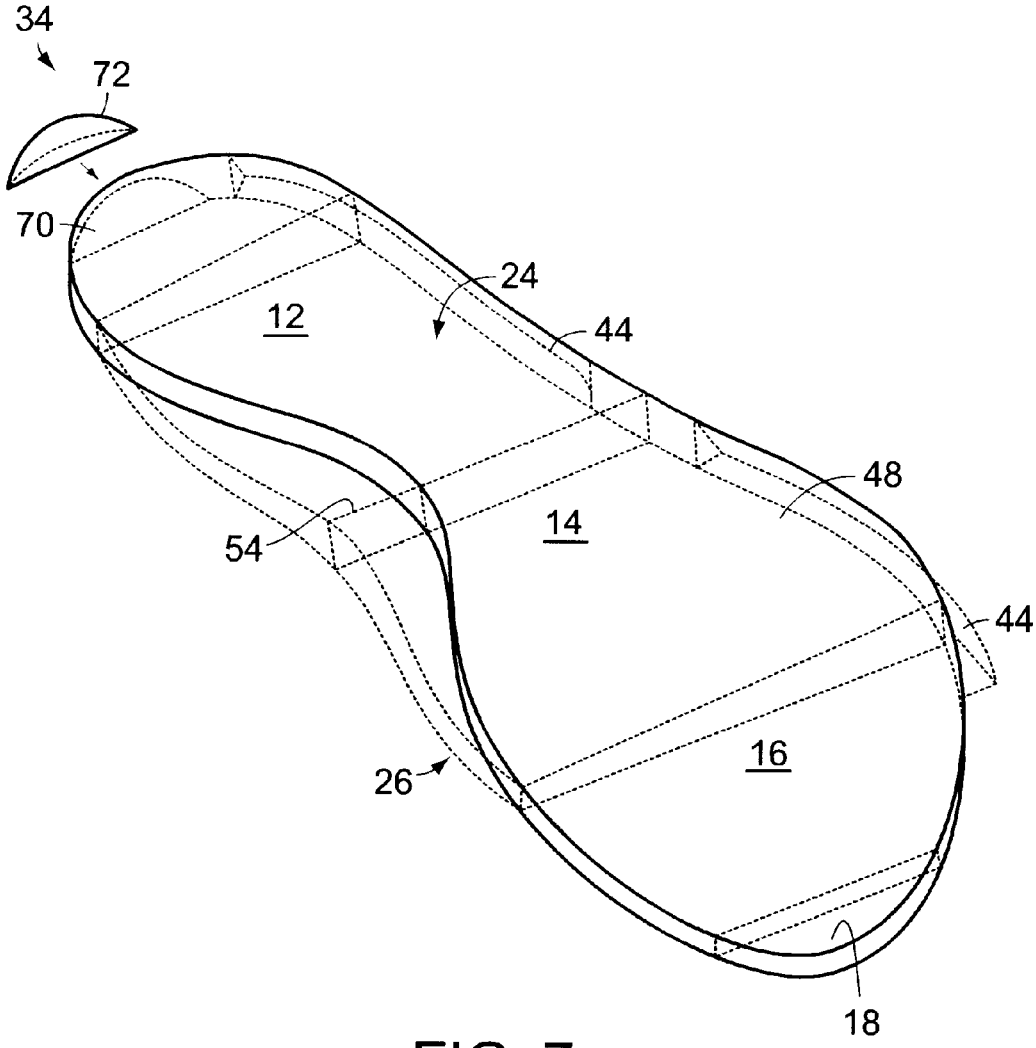
FIG. 7 illustrates a perspective view of the midsole of FIG. 3 having a beveled heel, a lateral flare, and including cushioned arch, lateral flare, and beveled heel inserts according to another embodiment of the present invention.

FIG. 7 illustrates an alternative embodiment of the midsole 34 according to the present invention. The midsole 34 is shaped to contour to a wearer's natural footprint, such that the body 48 is devoid of material beneath the arch portion of a wearer's foot. When used in a shoe, the midsole can include an arch insert 54 to fill the arch portion 56 (FIG. 1) between the arch support 50 (FIG. 6) and the outer sole 32 (FIG. 2) to help provide protection to the bottom of the foot and/or for aesthetic purposes.

The shoe construction of the present invention may include additional features as well. For example, referring to FIG. 7, the midsole 34 can include a beveled heel 70 extending between the medial 22 and lateral 20 sides of the heel portion 12 for reducing the external knee flexor and hip flexor torque in early stance. The beveled heel 70 is formed by a downward and forward slant extending from the top surface 24 to the bottom surface 26 of the body 48. The beveled edge can be flat, or can have other shapes, such as a rounded edge. A beveled cushion insert 72 can be provided to fill the space formed by the beveled heel 70. As compared to traditional footwear, the use of the beveled heel, alone or in combination with other features, will particularly help reduce the knee varus and hip adductor torques. These features reduce the knee and hip flexor torques as compared to traditional footwear as well as bare foot walking.

The midsole 34 can also include a lateral flare 44 extending substantially along the length of the lateral edge 20 of the body 48, that will also help transfer the body weight force to the lateral side of the foot, thereby reducing the knee varus and hip adductor torques. The lateral flare 44 is formed by a downward and outward (lateral) slant extending from the top surface 24 to the bottom surface 26 of the body 48. The lateral flare 44 can be formed integrally with the body 48 of the midsole 34, or it can be a separate member mated to the body 48.

Those having ordinary skill in the art will know, or be able to ascertain, using no more than routine experimentation, many equivalents to the specific embodiments of the invention described herein. These and all other equivalents are intended to be encompassed by the following claims. All publications and references cited herein including those in the background section are expressly incorporated herein by reference in their entirety.

What is claimed is:

1. A midsole for use in a shoe, comprising;

a body having a medial side and a lateral side, wherein the body includes a toe portion, a forefoot portion, a midfoot portion, and a heel portion, the height of the lateral side being greater than the height of the medial side at the heel and forefoot portions of the body; and a cantilevered foot support disposed on the body and adapted to support the medial side of a wearer's foot, wherein the cantilevered foot support includes a medial side and a lateral side, the cantilevered foot support being cantilevered such that the lateral side is anchored laterally and the medial side is floating.

2. The midsole of claim 1, wherein the height of the lateral side is substantially the same as the height of the medial side at the toe and midfoot portions of the body.

3. The midsole of claim 2, wherein the cantilevered foot support is mated to the lateral side of the body at the midfoot, heel, and/or forefoot portions.

4. The midsole of claim 3, wherein the cantilevered foot support is semi-rigid.

5. The midsole of claim 2, further comprising a lateral flare extending from the lateral side of the body at the forefoot and heel portions.

6. The midsole of claim 2, wherein the heel portion of the body further includes a beveled edge extending between the medial and lateral sides thereof.

7. The midsole of claim 2, wherein the height from the medial side to the lateral side defines a slope having an incline of between about 2° and 12°.

8. The midsole of claim 1, wherein the midsole supports the heel and forefoot portions at substantially the same height.

9. A shoe for supporting a wearer's foot, comprising:

an outer sole;

a midsole having an upper surface and a lower surface that is mated to the outer sole, the midsole comprising a body having a medial side and a lateral side, wherein the body includes a toe portion, a forefoot portion, a midfoot portion, and a heel portion, the height of the lateral side being greater than the height of the medial side at the heel and forefoot portions of the body, and a cantilevered foot support disposed on the body and adapted to support the medial side of a wearer's foot, wherein the cantilevered foot support includes a medial side and a lateral side, the cantilevered foot support being cantilevered such that the lateral side is anchored laterally and the medial side is floating; and an upper extending upwardly from the periphery of the midsole.

10. The shoe of claim 9, wherein the height of the lateral side is substantially the same as the height of the medial side at the toe and midfoot portions of the body.

11. The shoe of claim 10, further comprising a lateral flare extending from the lateral side of the body at the forefoot and heel portions.

12. The shoe of claim 11, wherein the heel portion of the body further includes a beveled edge extending between the medial and lateral sides.

13. The shoe of claim 12, further comprising a beveled cushion insert disposed between the beveled edge of the heel and the outer sole.

14. The shoe of claim 10, wherein the height from the medial side to the lateral side defines a slope having an incline of between about 2° and 12°.

15. The shoe of claim 10, further comprising a sock liner mated to the upper.

16. The shoe of claim 10, wherein the midsole supports the heel and forefoot portions at substantially the same height.

17. The shoe of claim 9, wherein the cantilevered foot support is mated to the lateral side of the body at the heel, midfoot, and/or forefoot portion.

18. The shoe of claim 9, wherein the cantilevered foot support is mated to the upper.

19. The shoe of claim 9, wherein the cantilevered foot support is integral with the upper.

20. The shoe of claim 9, wherein the cantilevered foot support is semi-rigid.

21. The shoe of claim 9, further comprising a cushioned arch insert disposed between the cantilevered foot support and the outer sole.

22. The shoe of claim 9, wherein the cantilevered foot support has an upwardly extending portion adapted to conform to an arch of a wearer's foot.

* * * * *